US006743159B1

(12) United States Patent
Taylor et al.

(10) Patent No.: US 6,743,159 B1
(45) Date of Patent: Jun. 1, 2004

(54) FOLDING PORTABLE EXERCISE APPARATUS

(76) Inventors: Joel A. Taylor, 36 Flintwood Dr., Little Rock, AR (US) 72227; Frank Perrien, 4395 Highway 92 W, Bee Branch, AR (US) 72013

( * ) Notice: Subject to any disclaimer, the term of this patent is extended or adjusted under 35 U.S.C. 154(b) by 0 days.

(21) Appl. No.: 10/367,309

(22) Filed: Feb. 19, 2003

(51) Int. Cl.[7] ..... A63B 21/045
(52) U.S. Cl. ..... 482/127; 482/126; 482/121
(58) Field of Search ..... 482/127, 121, 482/907, 126, 124, 140, 148, 139

(56) References Cited

U.S. PATENT DOCUMENTS 5,669,862 A * 9/1997 Sayman ..... 482/127
6,080,090 A * 6/2000 Taylor ..... 482/121
6,090,023 A * 7/2000 Liu ..... 482/140
D458,322 S * 6/2002 Rankin ..... 482/121

* cited by examiner

*Primary Examiner*—Jerome W. Donnelly

(57) ABSTRACT

A folding portable exercise apparatus having a contoured chest bar and a contoured lap bar. Two pairs of rods connect the bars. Each pair of rods is joined by a coil spring. An adjustable belt may be fastened around underneath the user. The device may be used to exercise the upper abdominal muscles, the triceps, the biceps, the pectoral muscles, the latissimus muscles, the back and lower abdominal muscles and the leg muscles such as calves, quadriceps, hamstring and gluteal muscles. The device may be disassembled and folded into a compact arrangement for storage and travel by detaching the coil springs from one pair of rods. This allows the device to be separated into components. The four rods may lie in the cavity along the major length of the respective chest bar and lap bars. The belt, springs and thumbscrews may then also lie together within the cavities and when closed produce a compact package the length and width of the chest bar and lap bar.

5 Claims, 10 Drawing Sheets

FIG. 14
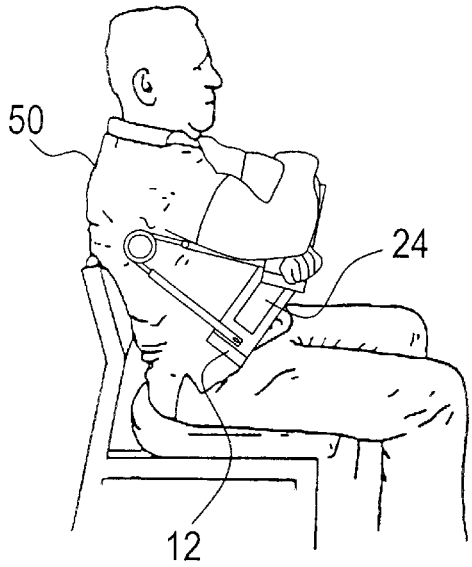
FIG. 15
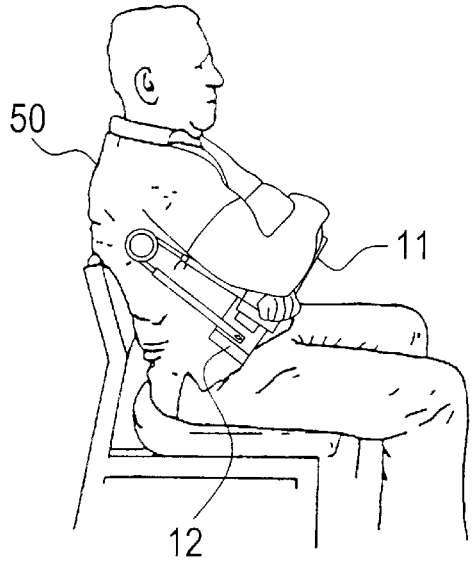
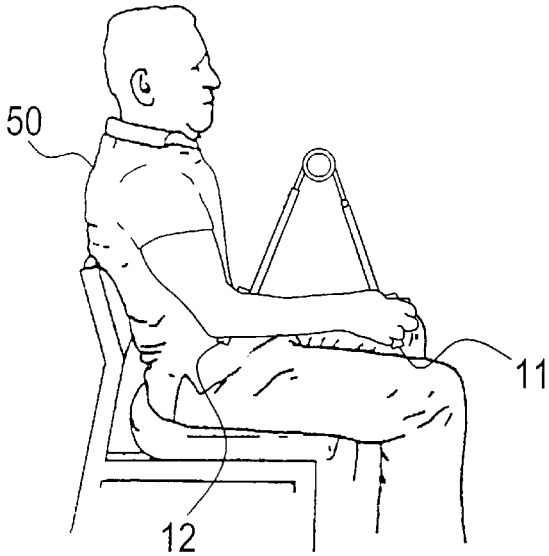
FIG. 16
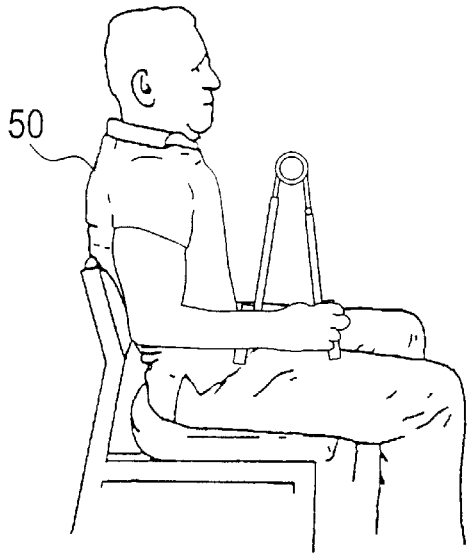
FIG. 17

FIG. 20
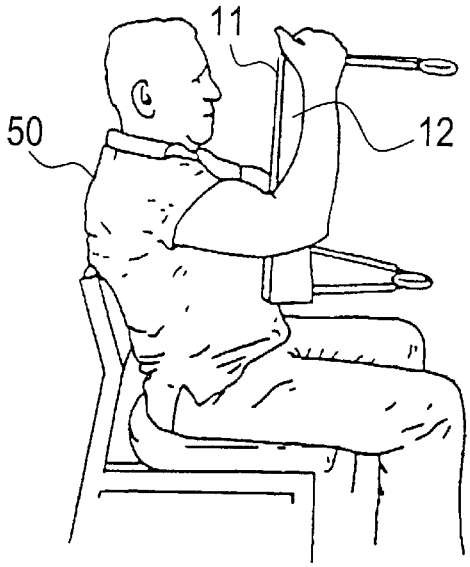
FIG. 21
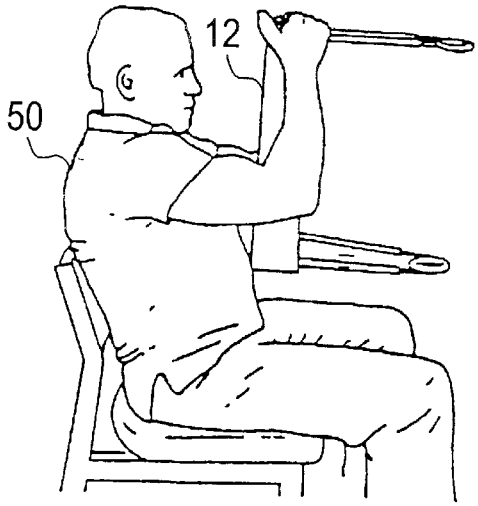
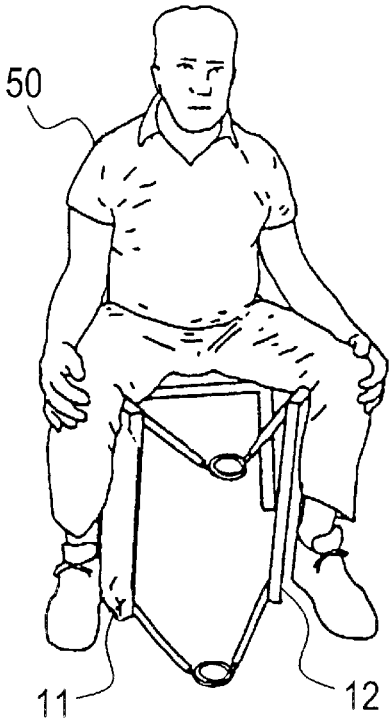
FIG. 22
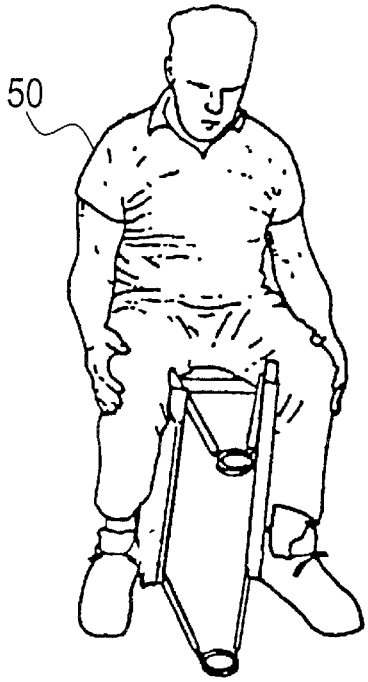
FIG. 23

FIG. 24
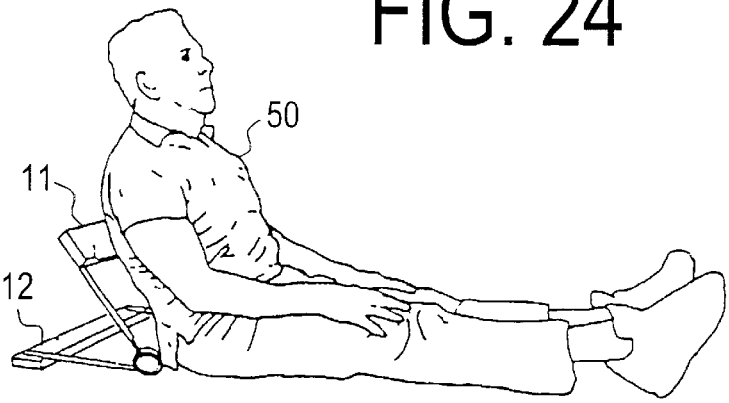
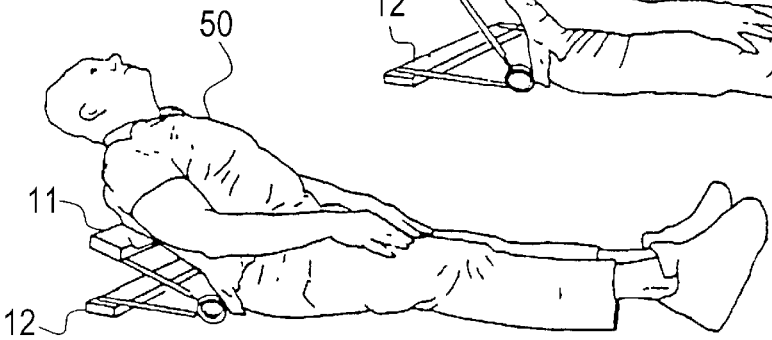
FIG. 25
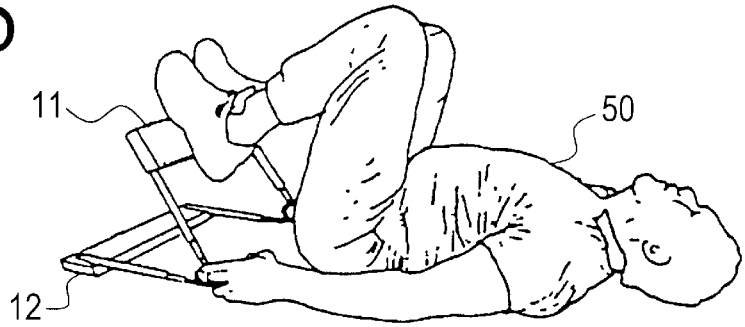
FIG. 26
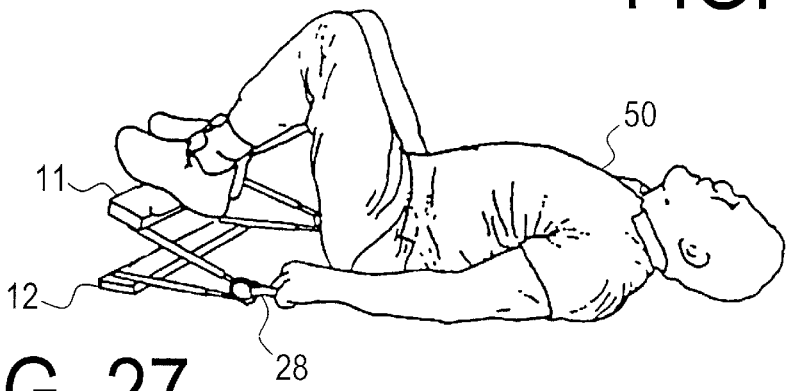
FIG. 27

FOLDING PORTABLE EXERCISE APPARATUS

BACKGROUND OF THE INVENTION

The present invention relates to a portable exercise device, and in particular, to a portable exercise device which is foldable for easy storage and transportation.

Medical authorities in recent years have expressed strong admonitions as to the healthful benefits of regular exercise. Regular exercise programs have therefore become a routine part of the daily schedule for many individuals. When events interfere with routine scheduling of exercise activities, such as business travel, the individual may find normal exercise activities difficult or impossible to perform. It is therefore desirable that exercise devices be made easily portable to allow continued exercise regimens by, for example, a busy executive in the office or even when traveling. Such a portable exercise apparatus is desirably small enough to fit in common traveling luggage and able to provide a substantial variety in the types of exercises available to the user. A number of attempts have been made to achieve these objectives.

For example, U.S. Pat. No. 5,669,862 to Sayman discloses a portable exercise device with longitudinal chest and lap bars and a torsion coil spring. The arms connecting the lap and chest bars to the coil spring are adjustable in length. The adjustable arms are fixed in position by tightening wingnuts.

U.S. Pat. No. 5,413,548 to Hoffman is similar in that a pair of padded longitudinal bars are connected by torsion means which may include a coil spring. The arms connecting the longitudinal bars are adjustable by means of a series of spring locked notches. The coil spring may be replaced by springs of greater or lesser strength. A variety of exercises are shown to be possible with the apparatus.

U.S. Pat. No. 5,224,914 to Friedman discloses a portable exercise device employing a padded chest bar and lap bars. The bars are attached to coil springs. An abdominal belt is used to hold the device in place on the user. Such a belt is also shown in U.S. Pat. No. 5,176,622 to Anderson et al.

While the devices described above are disclosed as being portable, a greater degree of compactness is desirable to render the exercise device truly portable to a business traveler or other person desiring ease of transportation with a high degree of exercise capability.

The present invention addresses this need as described below.

SUMMARY OF THE INVENTION

The present invention is a folding portable exercise apparatus. The invention comprises a chest bar that is contoured to lie across the upper chest of the user, and a lap bar which lies across the thighs of the user in a seated position. Two pairs of rods connect the chest bar and the lap bar. Each pair of rods is joined by a coil spring. The apparatus is provided with an adjustable belt threaded through each of the coil springs and may be fastened around and underneath the user. The belt is primarily used when the apparatus is employed for exercises in a seated position. In this configuration, the chest bar is placed across the upper chest of the user. The lap bar is placed across the thighs of the user in a seated position. The belt is fastened underneath the user so that the two coil springs are positioned in the vicinity of the user's hipbones. By adjusting the slide bracket on the belt one may lengthen or shorten the belt and thus provide suitable body contact of the lap and chest bars for the height of any user.

In this position, the user bends the upper torso forward toward the knees thus overcoming the resistance of the springs by exercising the abdominal muscles (abdominal crunches).

By using the arms alone to push down on the chest bar, the user may exercise the triceps. Or the user may place the hands under the lap bar and use the biceps to raise the lap bar up to join the chest bar.

Next, the user may reposition the lap bar against the abdomen so that the chest bar is extended from the body, level with the armpits. Placing the forearms on the chest bar, the user compresses the chest bar toward the lap bar working the latissimus muscles.

Furthermore, when the device is repositioned vertically, the user may exercise the pectoral muscles by placing the forearms along the outside of the respective bars and compressing the device using the arms and chest muscles alone. Also, the device may be placed on the floor and the user may exercise the back and lower abdominal muscles by assuming a seated position in front of the device with the legs bent at the knees or extended. The user may then operate the device by leaning back against the chest bar against the resistance supplied by the floor. Various other exercises are possible with the device.

A key feature of the invention is its ability to be disassembled and folded into a compact arrangement for storage and travel. Thumbscrews, set screws or similar means lock the pair of coil springs into the rods. By loosening the screws, the coil springs may be detached from one pair of rods. This allows the device to be separated into two components. One component comprises the chest bar, one pair of rods and the pair of coil springs. The other component comprises the lap bar and the other pair of rods. The rods are fastened to the respective chest bar or lap bar by nuts or similar means. The rods are held at right angles to the respective chest bar or lap bar by depressions in the respective chest bar and lap bar. When the rods are received in these depressions, they may be tightened in place by the nuts that tighten down on bolts passing through the bars and rods. When the nuts are removed the rods may lie nested along with the springs and belt in a hollowed out depression in each bar along the major length of the bars. Once all the hardware and belt are packed in the depressions the two halves are clamped snugly together and secured with a large rubber band around each end producing a compact package the length and width of the chest bar and lap bar. The folded apparatus is then of a size and shape that may be easily stowed in, for example, airline carry-on luggage.

It is therefore an object of the present invention to provide for a portable exercise apparatus that is able to exercise a variety of muscle groups.

It is a further object of the present invention to provide for a portable exercise apparatus that is foldable into a compact form for easy storage and transportation.

These and other objects and advantages of the present invention will be apparent from a consideration of the following detailed description of the preferred embodiments in conjunction with the appended drawings as described following.

BRIEF DESCRIPTION OF THE DRAWINGS

FIG. 14 is a side view of the user with the device repositioned with the lap bar against the abdomen so that the chest bar is extended from the body, level with the armpits. Placing the forearms on the chest bar, the user compresses the chest bar toward the lap bar working the latissimus muscles.

FIG. 15 is a side view of a user compressing the chest bar against lap bar resting against his lower abdomen thus exercising the latissimus muscles.

FIG. 16 shows a side view of the user with the either bar tucked up tight against his lower abdomen and the other bar located 'on the knee' position.

FIG. 17 shows the user pulling the outer bar towards his lower abdomen thus exercising the rear deltoids and the lower abdomen.

FIG. 20 is a side elevational view of a user employing the present invention to exercise the pectoral muscles. The view illustrates the starting or finishing position of the exercise.

FIG. 21 shows the user compressing the device thus exercising the pectoral muscles.

FIG. 22 is a side elevational view of a user employing the present invention to exercise the inner thigh muscles. The view illustrates the starting or finishing position of the exercise.

FIG. 23 is a side elevational view of a user employing the present invention to exercise the inner thigh muscles. The view illustrates the compressed position of the exercise.

FIG. 24 is a side elevational view of a user employing the present invention to exercise the back and lower abdominal muscles. The view illustrates the starting or finishing position of the exercise.

FIG. 25 is a side elevational view of a user employing the present invention to exercise the back and lower abdominal muscles. The view illustrates the compressed position of the exercise.

FIG. 26 is a side elevational view of a user employing the present invention to exercise the hamstring, quadricep, and gluteal muscles. The view illustrates the starting or finishing position of the exercise.

FIG. 27 is a side elevational view of a user employing the present invention to exercise the hamstring, quadricep, and gluteal muscles. The view illustrates the compressed position of the exercise.

DETAILED DESCRIPTION OF THE PREFERRED EMBODIMENTS

Figure 1:
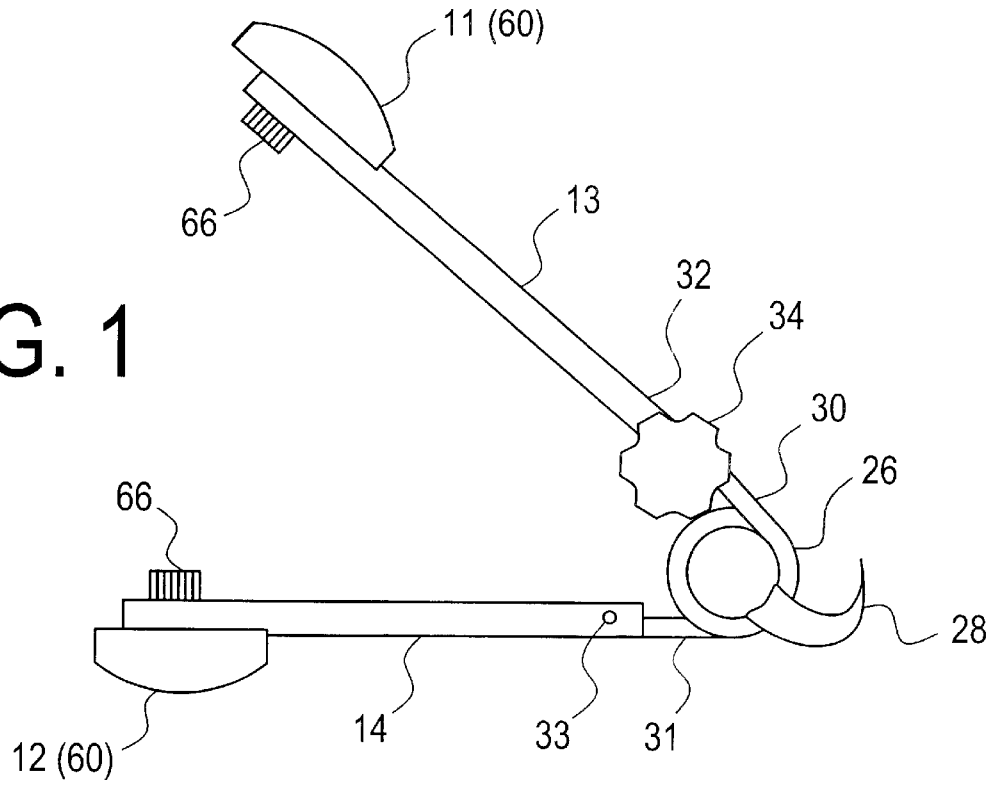
FIG. 1 is a left side elevational view of the present invention.
Figure 2:
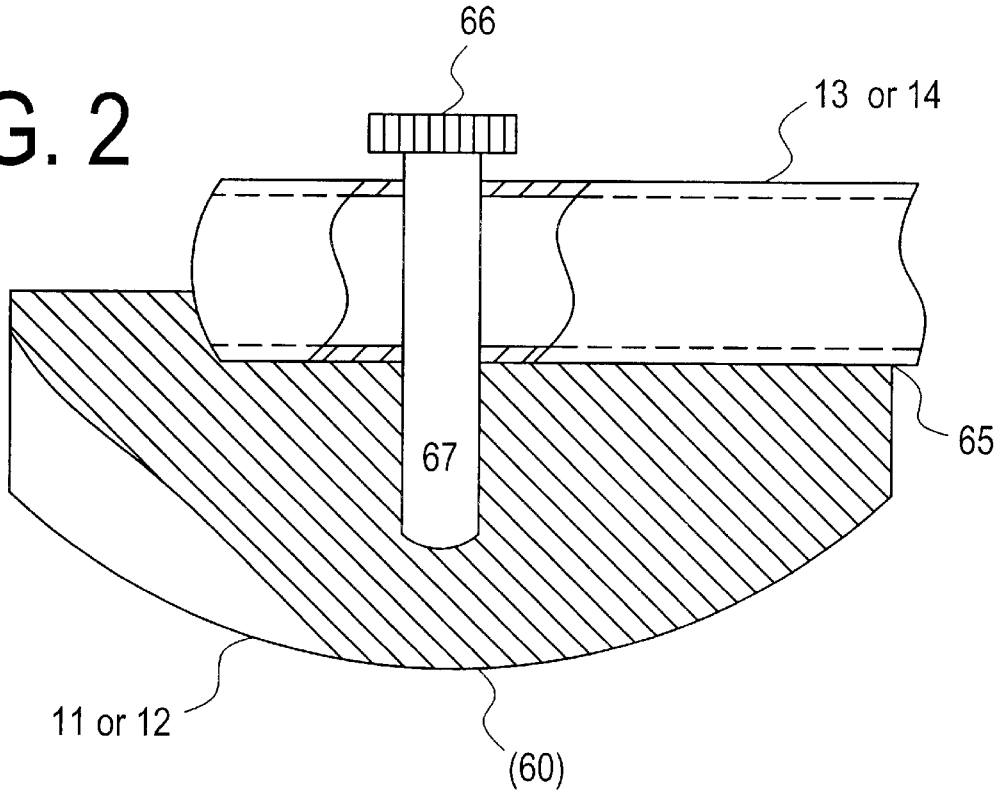
FIG. 2 is an offset sectional left elevational view of the chest bar showing a depression in the chest bar which holds a rod.

With reference to FIGS. 1–5, the preferred embodiment of the present invention may be described.

The present invention is a folding portable exercise device 10 as shown generally in FIGS. 1, 3, 4, and 5. The invention comprises a chest bar 11 that is desirably contoured to lie across the upper chest of the user 50, and a lap bar 12 which lies across the thighs of the user 50 in a seated position. A form of contoured area 60 is shown in FIGS. 1, 3, 4 and 5. Other forms of contouring may be employed in the invention.

Two pairs of rods 13, 14, connect the chest bar 11 and the lap bar 12. One pair of rods 13, 14 connect to the chest bar 11, and the other pair of rods 15, 16 connect to the lap bar 12. The locking screws may be a thumbscrew or similar device easily operated manually by the user.

Each pair of rods 13, 15 or 14, 16 is joined by coil spring 26, 27. Each coil spring 26, 27 is detachably mounted to the respective rods 13, 15, or 14, 16. With respect to FIG. 1 the attachment of the coil springs 26, 27 is shown with regard to coil spring 26. Coil spring 26 terminates in arms 30, 31 which are received into hollow ends 32, 33 respectively, of cylindrical rods 13 and 14. The same is true for coil spring 27 and cylindrical rods 15 and 16. It should be understood that rotational motion of arms 30, 31 relative to each other acts against the spring force of coil spring 26 and 27.

Thumbscrews 34 are threadedly received into hollow ends 32, 33 so as to bear against arms 30, 31. Thumbscrews 34 or similar devices easily operated manually by the user 50. Coil spring 27 is detachably mounted to rods 14, 16 in an identical manner.

The device 10 is provided with a belt 28 that is threaded through the coil springs 26 and 27 and then secured by buckle 70 to the device 10 and may be fastened around and underneath the user 50. The belt 28 is primarily used when the device 10 is employed in the seated position. The belt 28 is fastened underneath the buttocks of the user 50 so that the two coil springs 26, 27 are positioned in the vicinity of the hipbones of the user 50. The adjustability of the belt easily provides the device flexibility to be employed by all users regardless of their height. As the belt is loosened the angle where the coil springs join the rods moves forward to allow the lap and chest bars to move further along their respective members—thighs and chest—so that the desired position for compression is maintained.

A key feature of the device 10 is its ability to be disassembled and folded into a compact arrangement for storage and travel. This feature may be described with reference to FIGS. 2 and 5. As described above, thumbscrews 34 detach the pair of coil springs 26, 27 from the rods 13, 14, 15, 16. By loosening the thumbscrews 34, the coil springs 26, 27 may be detached from one of the rods; e.g., 13, 14. This allows the device to be separated into two components. One component comprises the chest bar 11, rods 13, 14 and the pair of coil springs 26, 27. The other component comprises the lap bar 12 and the other rods 15 and 16.

Figure 3:
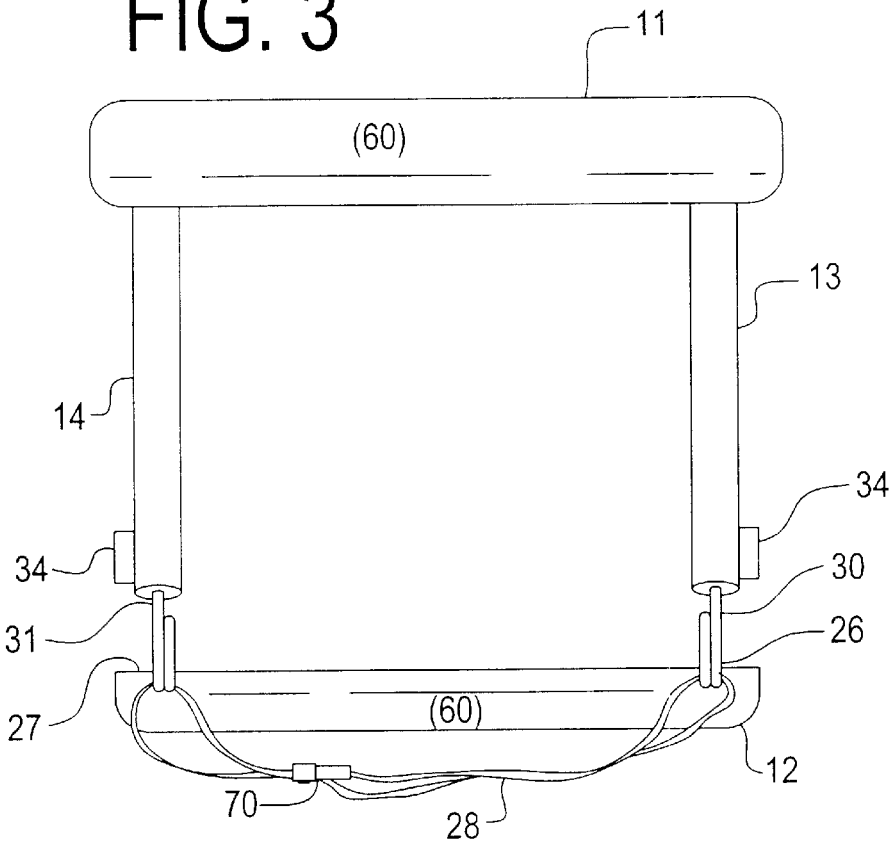
FIG. 3 is a front elevational view of the present invention.

The two components described above may then be further folded. Rods 13 and 15 are fastened to a respective chest bar 11 or lap bar 12 as shown in FIG. 3. The attachment between the chest bar 11 and rod 13, and the attachment between the lap bar 12 and rod 15, is identical.

Figure 4:
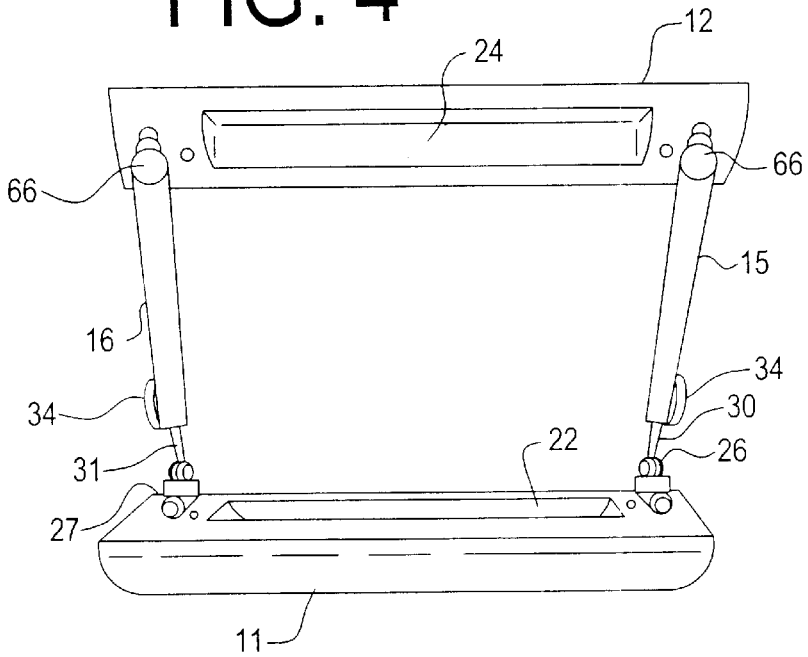
FIG. 4 is a rear elevational view of the present invention.
Figure 5:
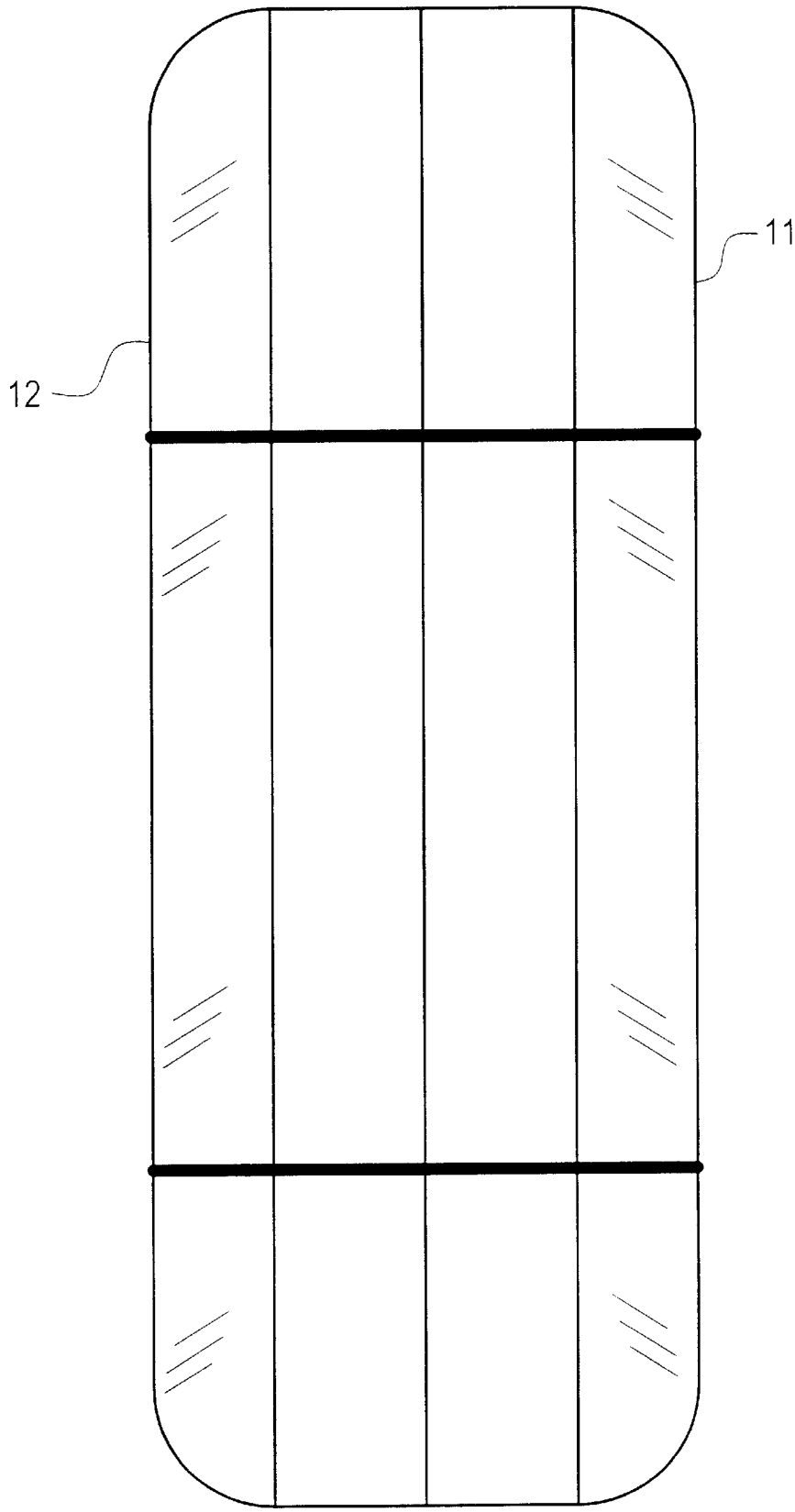
FIG. 5 is a view of the present invention disassembled and packed for transport or storage with two large rubber bands around the respective lap and chest bars which are fitted tightly together in a clamshell manner.

When the device 10 is fully assembled rod 13 is held at right angles to chest bar 11 by a depression 65 in chest bar 11. When rod 13 is received in depression 65, it may be fixed in place by a thumbscrew 66 that fastens down into insert 67 positioned in the chest bar 11. When the thumbscrew 66 is loosened sufficiently, the rod 13 may be lifted out of depression 65 so that it may be folded to lie in the cavity 22 of chest bar 11 as shown in FIG. 4. Belt 28 along with the thumbscrews, 34 and 66, as well as the rods 13, 14, 15 and 16 may be placed in the cavity 24 of lap bar 12 producing a compact package approximately the length and width of chest bar 11 and lap bar 12. The folded device 10 is then of a size and shape that may be easily stowed in, for example, airline carry-on luggage.

By using the compact folding exercise device of the present invention, it is possible to exercise ten major muscle groups.

Figure 6:
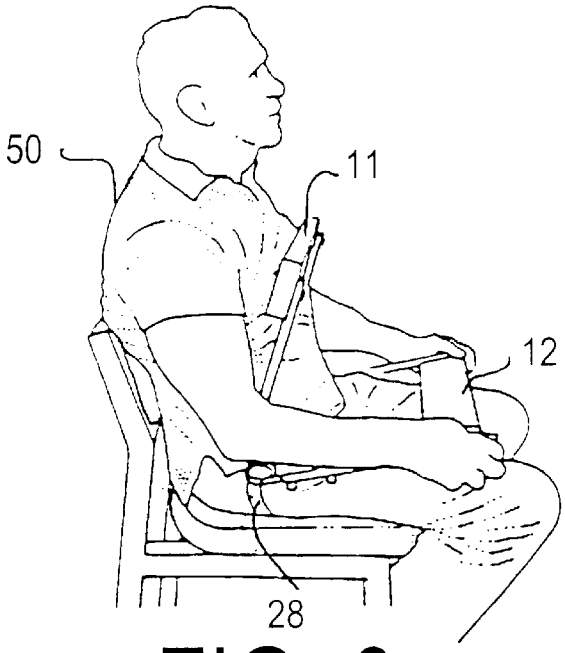
FIG. 6 is a side elevational view of a user employing the present invention to exercise the abdominal muscles. The view illustrates the starting or finishing position of the exercise.
Figure 7:
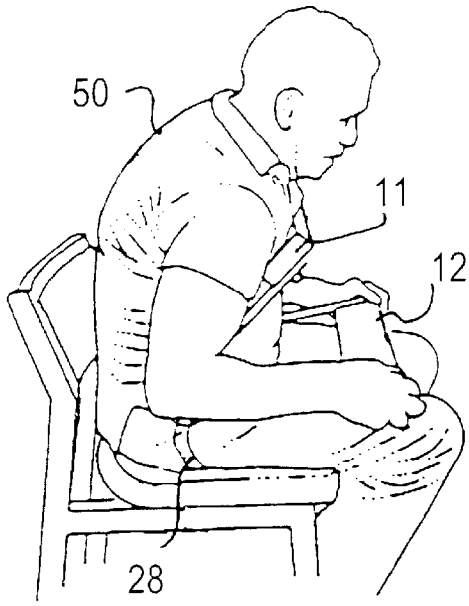
FIG. 7 is a side elevational view of a user employing the present invention to exercise the abdominal muscles. The view illustrates the compressed position of the exercise.

Exercising the abdominal muscles is shown in FIGS. 6 and 7. The user 50 is seated, the device is placed so that the lap bar 12 is resting on the thighs of the user 50 and the chest of the user 50 is resting against the chest bar 11 as shown in FIG. 6. The hands of the user 50 are placed on the outside edges of the lap bar 12 and the user bends forward against the chest bar 11 compressing the device 10 through an approximately 90 degree arc toward the lap bar 12 as shown in FIG. 7. The belt 28, under the user's buttocks during this exercise, holds the device 10 in place.

Figure 8:
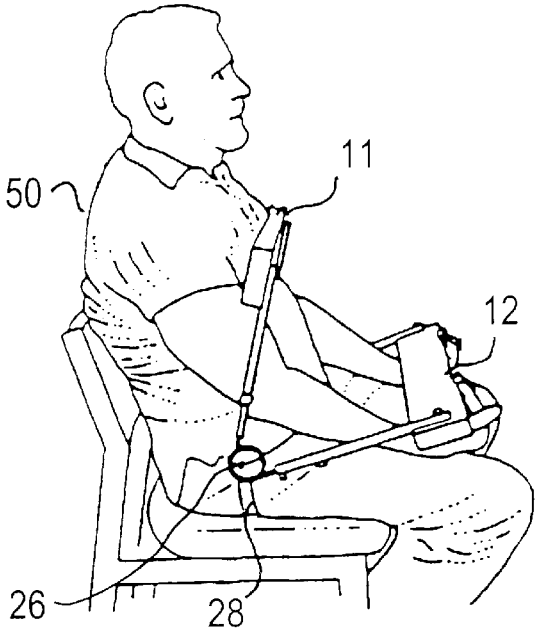
FIG. 8 is a side elevational view of a user employing the present invention to exercise the bicep muscles. The view illustrates the starting or finishing position of the exercise.
Figure 9:
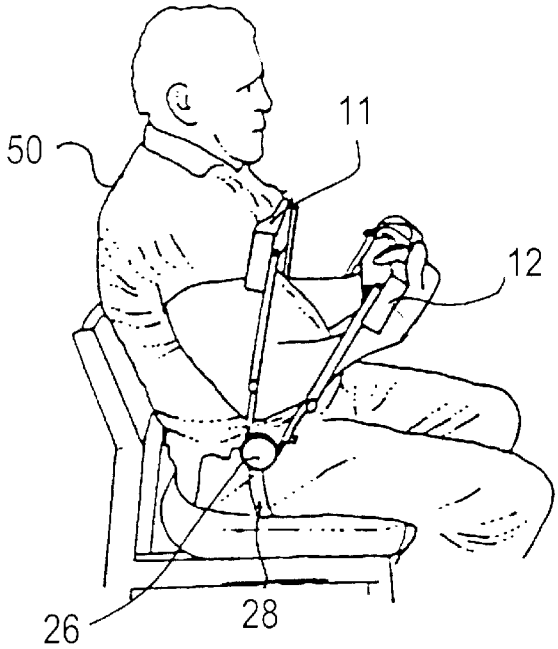
FIG. 9 is a side elevational view of a user employing the present invention to exercise the bicep muscles. The view illustrates the compressed position of the exercise.

Exercising the biceps is shown in FIGS. 8 and 9. The user 50 is again in a seated position with the chest bar 11 against the chest of the user 50. The palms of the user 50 are placed under the lap bar 12 while the belt 28 is fastened under the buttocks of the user 50 as shown in FIG. 8. The lap bar 12 is raised through a 90 degree arc to the chest as shown in FIG. 9.

Figure 10:
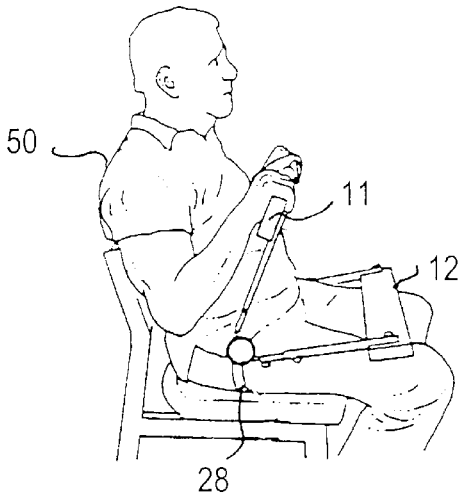
FIG. 10 is a side elevational view of a user employing the present invention to exercise the tricep muscles. The view illustrates the starting or finishing position of the exercise.
Figure 11:
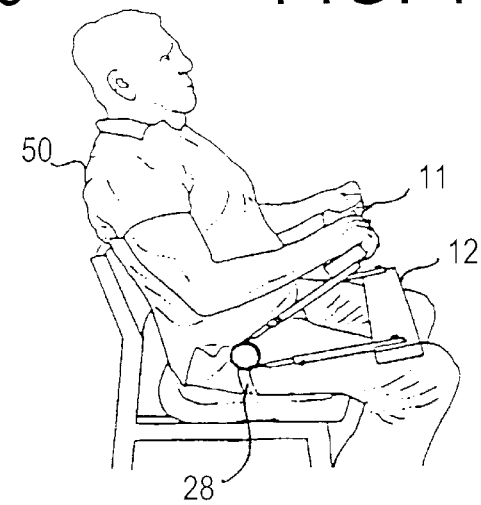
FIG. 11 is a side elevational view of a user employing the present invention to exercise the tricep muscles. The view illustrates the compressed position of the exercise.

Exercising the triceps is shown in FIGS. 10 and 11. The user 50 is in a seated position with the lap bar 12 against the thighs of the user 50, the palms of the user 50 are placed behind the chest bar 11 and using the arms alone, the user 50 presses the chest bar 11 down toward the lap bar 12 as shown in FIG. 11. The belt 28 is also used in this exercise.

Figure 12:
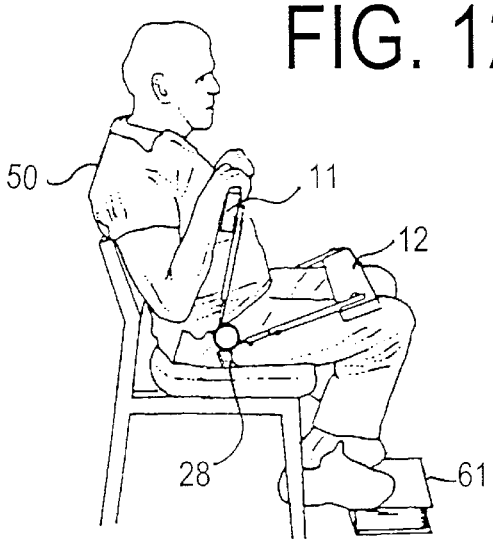
FIG. 12 shows the user employing the present invention to exercise the calf muscles. The view illustrates the starting or finishing position of the exercise.
Figure 13:
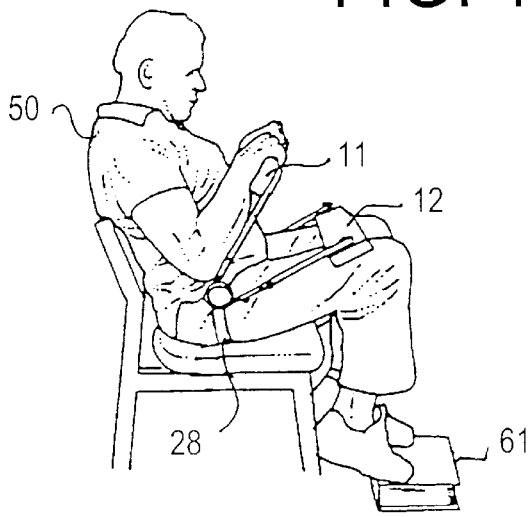
FIG. 13 is a side elevational view of a user employing the present invention to exercise the calf muscles. The view illustrates the compressed position of the exercise.

Exercising the calves is shown in FIGS. 12 and 13. The user 50 is seated with the lap bar 12 against the thighs of the user 50. The user 50 places the balls of the feet on a book or similar item 61 to raise the heels of the feet approximately 3 inches off the floor as shown in FIG. 13. The user 50 places the palms behind the chest bar 11 to provide resistance and the user 50 raises the heels to compress the lap bar 12 toward the chest bar 11 as shown in FIG. 13. The belt 28 may also be fastened beneath the user 50 in this exercise.

Exercising the latissimus muscles FIG. 14 is achieved by placing the lap bar tight against the upper abdominal and the chest bar out so that the folded forearms lie horizontally along the bar. The user then presses the chest bar 11 down until it reaches maximum compression nearing the lap bar 12, FIG. 15.

To exercise the post deltoids, latissimus and abdominals place the lap bar 12 against the belly and the chest bar 11 across the knees so that the device 10 is in an inverted position The belt 28 is not used in this exercise. The hands of the user 50 are placed on each end of the chest bar 11 as shown in FIG. 16. Then the user 50 pulls the chest bar 11 back towards the belly thus compressing the device 10 as shown in FIG. 17.

Figure 18:
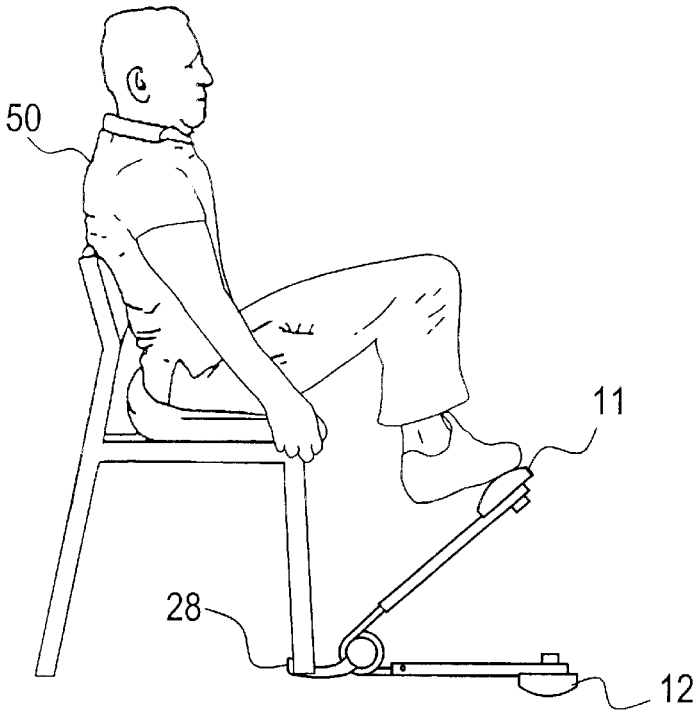
FIG. 18 is a side view of the user sitting in an upright chair with the back of the chair against the wall or table and with his feet on the chest bar and the lap bar on the floor. The belt is secured in place by its wrapped position around the legs of the chair. Both feet of the user are placed on top of the chest bar. The user holds firm to the edge of the chair on which he is sitting.
Figure 19:
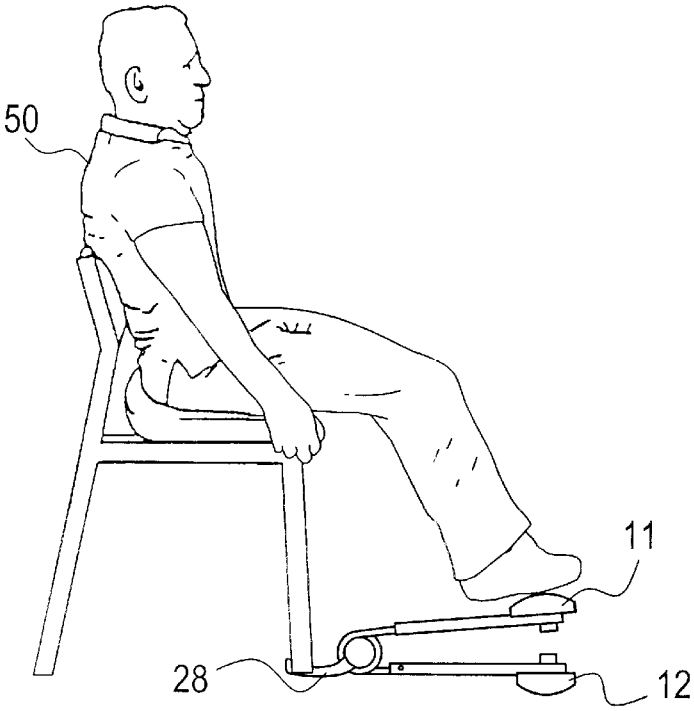
FIG. 19 shows the user extending his legs downward thus exercising the quadriceps.

FIG. 18 shows the user 50 exercising the quadriceps and gluteal and hamstring muscles. The user 50 is seated in a straight back chair, which is positioned with its back against a wall or a table so that it cannot tip over backward. The chest bar 11 or the lap bar 12—either bar is suitable—is placed on the floor and the belt 28 is secured by the front legs of the chair. The user 50 places his feet on the upright bar and presses forward so that his leg muscles compress the top bar downward toward the floor thus exercising the leg muscles.

Exercising the pectorals (chest muscles) is shown in FIGS. 20 and 21. The belt 28 is not used in this exercise. The user 50 is seated and the device 10 is turned vertically with the forearms of the user 50 placed along the outer surfaces of the bars 11, 12 as shown in FIG. 20. The user 50 compresses the lap bar 12 toward the chest bar 11 using the chest muscles as shown in FIG. 21.

Exercising the inner thigh muscles is shown in FIGS. 22 and 23. The belt 28 is not used with this exercise. The user 50 is seated and the device 10 is placed in the vertical position between the knees with the bars 11, 12 placed along each shin of the user 50 as shown in FIG. 22. The device 10 is compressed using only the thigh muscles as shown in FIG. 23.

Exercising the back and lower abdominals is shown in FIGS. 24 and 25. The belt 28 is not used in this exercise. The lap bar 12 is placed flat on the floor and the user 50 sits on the floor with the chest bar 11 below the shoulders of the user 50 as shown in FIG. 25. The user 50 reclines against the chest bar 11 as shown as shown in FIG. 20 by tightening the back muscles and then returns to the upright seated position of FIG. 24 by tightening the lower abdominal muscles.

Additional exercises for the hamstring, quadriceps, and gluteals are shown in FIGS. 26 and 27. The belt 28 can be used in this exercise to maintain the device in place. The lap bar 12 is placed flat on the floor. The user 50 is supine with the knees raised and the feet placed against the chest bar 11 as shown in FIG. 26. The user 50 holds the belt 28 or the coil springs 26 and 27 to keep the device 10 in place. The chest bar 11 is compressed toward the lap bar 12 by extending the quadriceps and the gluteal muscles as shown in FIG. 27. The chest bar 11 is returned to the upright position of FIG. 26 by relaxing the quadricep muscles.

Figure 28:
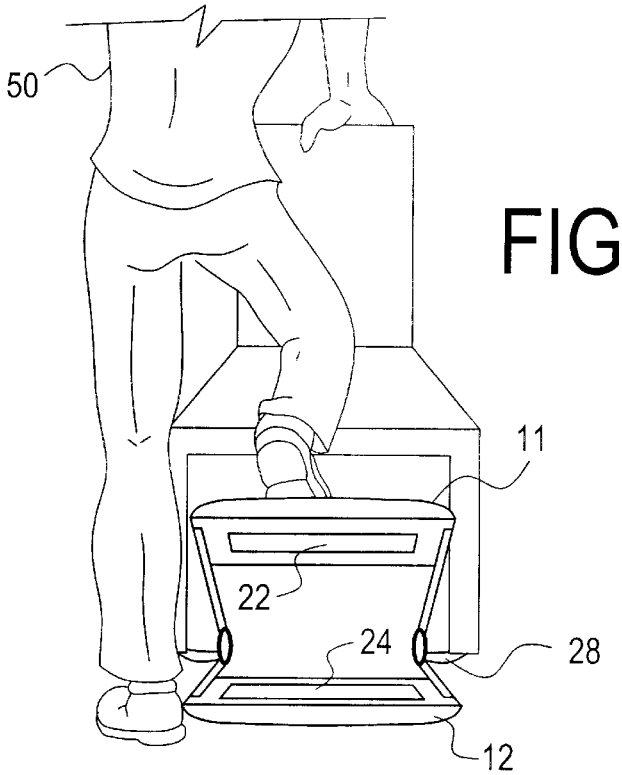
FIG. 28 shows another position for starting the quadriceps and gluteal muscle exercise. A chair back is against a table or desk so that the belt is secured under the front legs and the device is open away from the chair. The user faces the desk or table and places either foot on top of the upright bar.
Figure 29:
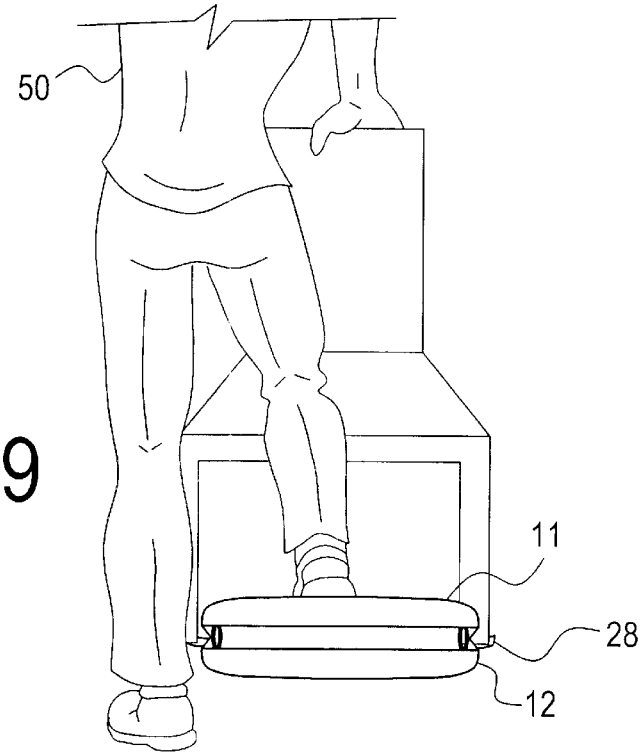
FIG. 29 shows the user extending his foot downward so that he has compressed the springs and thus exercised his quadriceps and his buttocks, (gluteal muscles).

Single leg exercises to focus the gluteals, quadriceps and calves are shown in FIGS. 28 and 29. The user 50 places the device 10 directly in front of a straight back chair with either bar 11 or 12 on the floor and the coil springs 26 and 27 next to the forelegs of the chair. The belt 28 is placed around the chair forelegs to secure the device 10 in position. The user 50 places both hands on the back of the chair and one foot on the upper bar, FIG. 28. Then the user 50 presses downward with that foot and leg to compress the device 10 for ten to 12 repetitions, then changes and repeats with the other leg, FIG. 29.

The user may perform the exercises in a variety of circumstances. For example, the user may be watching television and take advantage of the commercial interruptions for exercise. The first nine exercises described above may be performed while seated in front of the television without leaving the chair. The next two exercises require the use of the invention in a supine position and the last is done standing, but all three could also be performed without leaving the television set. It should be understood that the invention may also be used in a number of other circumstances, such as by a business traveler in a hotel room and even by a businessperson in the office.

The number of repetitions and the number of sets of each exercise may be determined by the user. A recommended regimen is five to ten repetitions of each exercise with the user working up to three sets of repetitions of each exercise.

The present invention has been described with reference to certain preferred and alternative embodiments which are intended to be exemplary only and not limiting to the full scope of the present invention as set forth in the appended claims.

What is claimed is:

1. A folding portable exercise apparatus, comprising:

a first bar having a first longitudinal axis;

a second bar having a second longitudinal axis;

a first pair of rods each having a proximal end and a distal end, means for pivotally connecting said proximal ends of said first pair of rods to said first bar allowing movement of said first pair of rods between a folded position wherein said rods lie substantially along said first longitudinal axis and an unfolded position wherein said rods lie substantially at right angles to said second longitudinal axis;

means for locking said first pair rods in said unfolded position;

a second pair of rods each having a proximal end and a distal end, means for pivotally connecting said proximal ends of said second pair of rods to said second bar allowing movement of said second pair of rods between a folded position wherein said rods lie substantially along said second longitudinal axis and an unfolded position wherein said rods lie substantially at right angles to said second longitudinal axis;

means for locking said second pair of rods in said unfolded position;

a pair of coil springs, each having a helically wound portion and a first and second projecting arm, said projecting arms diverging from each other at a given acute angle; means for removably connecting each of said first projecting arms to a respective one of said distal ends of said rods attached to said first bar; and means for removably connecting each said second projecting arms to a respective one of said distal ends of said arms attached to said second bar, and; wherein said means for locking said first and second pairs of rods in said unfolded position comprises an indentation in each of said first and second bars at each of said proximal ends of said rods and traverse to said longitudinal axes of said bars, a pin affixed in each of said indentations said pin passing through an opening in said proximal ends of said rods allowing pivotal motion of said rods with respect to said pins and further allowing said distal ends to lie within said indentations in said unfolded positions and to lie outside of said indentations in said. folded position.

2. The folding portable exercise apparatus of claim 1 further comprising an abdominal belt and means for removable attachment of said abdominal belt to said coil springs.

3. The folding portable exercise apparatus of claim 1 wherein said first bar comprises a bar contoured to fit the chest of a user.

4. The folding portable exercise apparatus of claim 1 wherein said second bar comprises a bar contoured to fit the lap of a user.

5. The folding portable exercise apparatus of claim 1 further comprising cavities in both the lap and chest bars, which provide storage space for all of the hardware, creating a self-contained, easily portable unit, when the unit is assembled it offers a variety of exercise functions that utilize 12 of the major muscle groups.

* * * * *